US006123200A

United States Patent [19]

Stephens et al.

[11] Patent Number: 6,123,200

[45] Date of Patent: Sep. 26, 2000

[54] FRAGILITY PACKAGING ARTICLE WITH CONTROLLED RESILIENCY

[75] Inventors: Thomas B. Stephens, Los Gatos; Fred Schindler, Santa Cruz, both of Calif.

[73] Assignees: Plastofilm Industries, Wheaton, Ill.; Robert, Stephens, Van Amburg Packaging, Soquel, Calif.

[21] Appl. No.: 09/286,858

[22] Filed: Apr. 6, 1999

[51] Int. Cl.[7] ..... B65D 81/02

[52] U.S. Cl. ..... 206/592; 206/320; 206/701

[58] Field of Search ..... 206/586, 592, 206/591, 521, 320, 701, 710

[56] References Cited

U.S. PATENT DOCUMENTS

| | | | |
|---|---|---|---|
| 1,958,050 | 5/1934 | Koppelman . | |
| 2,746,667 | 5/1956 | Murphy . | |
| 2,783,879 | 3/1957 | Emery . | |
| 2,808,189 | 10/1957 | Williams . | |
| 2,863,595 | 12/1958 | Emery . | |
| 3,266,705 | 8/1966 | Wood . | |
| 3,305,084 | 2/1967 | Higgins et al. . | |
| 3,502,241 | 3/1970 | Smith . | |
| 3,807,622 | 4/1974 | Belcher et al. . | |
| 3,856,137 | 12/1974 | Brindley . | |
| 4,113,095 | 9/1978 | Dietz et al. . | |
| 4,658,567 | 4/1987 | Arada . | |
| 4,953,705 | 9/1990 | Evamy . | |
| 5,016,751 | 5/1991 | Creaden . | |
| 5,058,744 | 10/1991 | Creaden . | |
| 5,226,543 | 7/1993 | Foos et al. . | |
| 5,335,770 | 8/1994 | Baker et al. . | |
| 5,360,109 | 11/1994 | Janota . | |
| 5,385,232 | 1/1995 | Foos et al. . | |
| 5,450,959 | 9/1995 | Philippi . | |
| 5,515,976 | 5/1996 | Moren et al. . | |
| 5,636,744 | 6/1997 | Hirose | 206/586 |
| 5,678,692 | 10/1997 | Gratz | 206/523 |
| 5,706,951 | 1/1998 | Oinuma et al. | 206/710 |
| 5,799,796 | 9/1998 | Azelton et al. . | |

FOREIGN PATENT DOCUMENTS

| | | |
|---|---|---|
| 1205747 | 2/1960 | France . |
| 30 10 066 | 9/1981 | Germany . |
| 94 05 638 | 7/1994 | Germany . |
| 596274 | 7/1959 | Italy . |
| 870704 | 6/1961 | Spain . |

*Primary Examiner*—Paul T. Sewell
*Assistant Examiner*—Nhan T. Lam
*Attorney, Agent, or Firm*—Greer, Burns & Crain, Ltd.

[57] ABSTRACT

A structure for packaging a shock sensitive article within a container having a plurality of panels includes a flange having a bottom surface, and a peripheral portion including a pair of opposing sides, and the flange defines an article containing space. A first sidewall and a second sidewall are located along the opposing sides of the flange, the first and second sidewalls each include an inboard wall integral with the peripheral portion of the flange, an outboard wall having an article end and a container end depending from the bottom surface, and a bridge portion joining corresponding edges of the inboard wall and the outboard wall to form a cushion space. At least one column formation is formed integrally with the first sidewall and the second sidewall, each of the column formations has an inside wall and an outside wall, and extends from the inboard wall into the article containing space to be closer to the opposing column formation than the inboard walls are to each other. The inside wall is configured for supportingly extending over an end portion of the article.

22 Claims, 6 Drawing Sheets

FRAGILITY PACKAGING ARTICLE WITH CONTROLLED RESILIENCY

BACKGROUND OF THE INVENTION

The present invention relates to packaging for fragile structures such as printed circuit boards, disk drives, computer monitors or the like. More particularly, the invention relates to a flexible, thermally formed type of plastic packaging, of unitary construction, which is configured for supporting such fragile articles and for dissipating forces exerted upon shipping cartons containing such articles in such a manner that the articles are not damaged if the carton is dropped or mishandled.

Currently, the shipment of fragile articles, regardless of size and weight, requires special packaging to avoid damage to the articles. For this purpose, materials such as crumpled paper, nuggets of expanded foam, and/or preformed expanded polystyrene foam are used to package fragile articles, including but not limited to electronic articles such as computer monitors, radios, television sets, computer CPUs, computer disk drives, microwave ovens, VCR's and the like. The preformed polystyrene foam material is often provided in the form of "corners" or other support pieces which envelop at least portions of the packaged fragile article.

Aside from being bulky, upon an initial impact, the polystyrene foam loses virtually all of its shock absorbing qualities. Thus, fragile articles packaged with rigid pieces of expanded polystyrene foam as the protective media are susceptible to damage from repeated shocks to the box or container. A related disadvantage of such foam packaging is that a relatively thick piece of foam must be employed to protect a packaged article from impact, even though only a portion of the foam will be compressed upon impact.

Another disadvantage of conventional polystyrene foam is that its bulkiness requires packagers to allot significant warehouse storage space to the foam packaging elements prior to use. Also, shippers are required to select shipping containers, such as corrugated boxes, which are substantially larger than the article being packaged, merely to accommodate sufficient thicknesses of polystyrene foam which can absorb only one impact. Larger containers require additional warehouse space, both before and after assembly, and also take up more space per article shipped in rail cars or trailers.

Yet another disadvantage of conventional packaging for fragile articles is that because of its bulkiness, it is not generally economically feasible to ship the expanded polystyrene foam to a recycling location. Furthermore, even when the expanded polystyrene foam is recycled into product, the cost of recycling is relatively large and, generally, no more than about 25% recycled content can be utilized, with the remainder being virgin material. Indeed, considering the great quantity of expanded polystyrene foam which is currently in use to provide fragility packaging and the general lack of adequate recycling of this material, the adverse environmental impact is of staggering proportions. The present invention is directed to overcoming one or more of the above-identified problems.

Commonly-assigned U.S. Pat. No. 5,226,543 discloses a package for fragile articles which addresses the above-listed problems, and provides a solution in the form of a unitary package having a platform portion held a specified distance above the substrate by a peripheral wall formation which also borders the platform portion. Shock limiting formations are formed in the sidewall structure for restricting the movement of the platform portion toward the lower edge of the peripheral wall upon shock loading of the platform.

Commonly-assigned U.S. Pat. No. 5,915,976 discloses another type of thermoformable fragility package known in the industry as an "end cap" package. The package of the '976 Patent features collapsible crush buttons which depend from the article-retaining platform portion to provide additional shock absorption properties.

In use, it has been found that when packaged articles are relatively lightweight, the above-identified shock limiting packages may be too rigid or stiff. As such, the platform portion may not move a sufficient amount toward the peripheral wall upon shock loading, and the shock forces are absorbed by the packaged article instead of by the package.

It has also been found that conventional packages of this type do not exert enough gripping force on the packaged article to securely retain the packaged article.

Another disadvantage of conventional thermoformed fragility packaging is that in some cases, shock events are visible on the package as creases, folds, or other malformations which raise a suspicion in the consumer's mind that the product has been damaged, and thus detracts from the marketability of the article being packaged. It is believed that such malformations are the result of the package being overly stiff.

Accordingly, it is an object of the present invention to provide an improved unitary shock-resistant package for fragile articles which deforms to absorb shock loading even when the packaged article is relatively lightweight.

Another object of the present invention is to provide an improved shock-resistant package for fragile articles in which the deformability of the package is adjustable to suit the particular packaged article.

A still further object of the present invention is to provide an improved shock-resistant package which securely retains the packaged article, and may be configured to reduce visible malformations due to shock events.

BRIEF SUMMARY OF THE INVENTION

The above listed objects are met or exceeded by the present package for packaging a shock sensitive article within a container having a plurality of panels, such as a corrugated carton. A feature of the present package is the provision of controlled resiliency, achieved in part by at least one and preferably a pair of vertically extending column formations located on corresponding opposed sidewalls. The column formations exert a frictional gripping force on the packaged article to more securely retain it in place. In addition, the column formations maybe provided in a variable configuration to adjust or "tune" the resiliency of the package to suit a particular packaged article.

More specifically, the present invention provides a structure for packaging a shock sensitive article within a container having a plurality of panels. The structure includes a flange having a bottom surface, and a peripheral portion including a pair of opposing sides, and the flange defines an article containing space. A first sidewall and a second sidewall are located along the opposing sides of the flange, the first and second sidewalls each include an inboard wall integral with the peripheral portion of the flange, an outboard wall having an article end and a container end depending from the bottom surface, and a bridge portion joining corresponding edges of the inboard wall and the outboard wall to form a cushion space.

At least one column formation is formed integrally with the first sidewall and the second sidewall, each of the column formations has an inside wall and an outside wall, and extends from the inboard wall into the article containing space to be closer to the opposing column formation than the inboard walls are to each other. The inside wall is configured for supportingly extending over an end portion of the article.

Preferably, each column formation includes at least one V-groove to allow the article to function as cushion. A hinge point of the V-groove permits the package structure to compress, but also to return to its original position due to the inherent memory of the material. Thus, the structure includes resilience and return qualities to allow for continued protection of the shock sensitive article even after the package has suffered repeated disturbances.

DETAILED DESCRIPTION OF THE INVENTION

Figure 1:
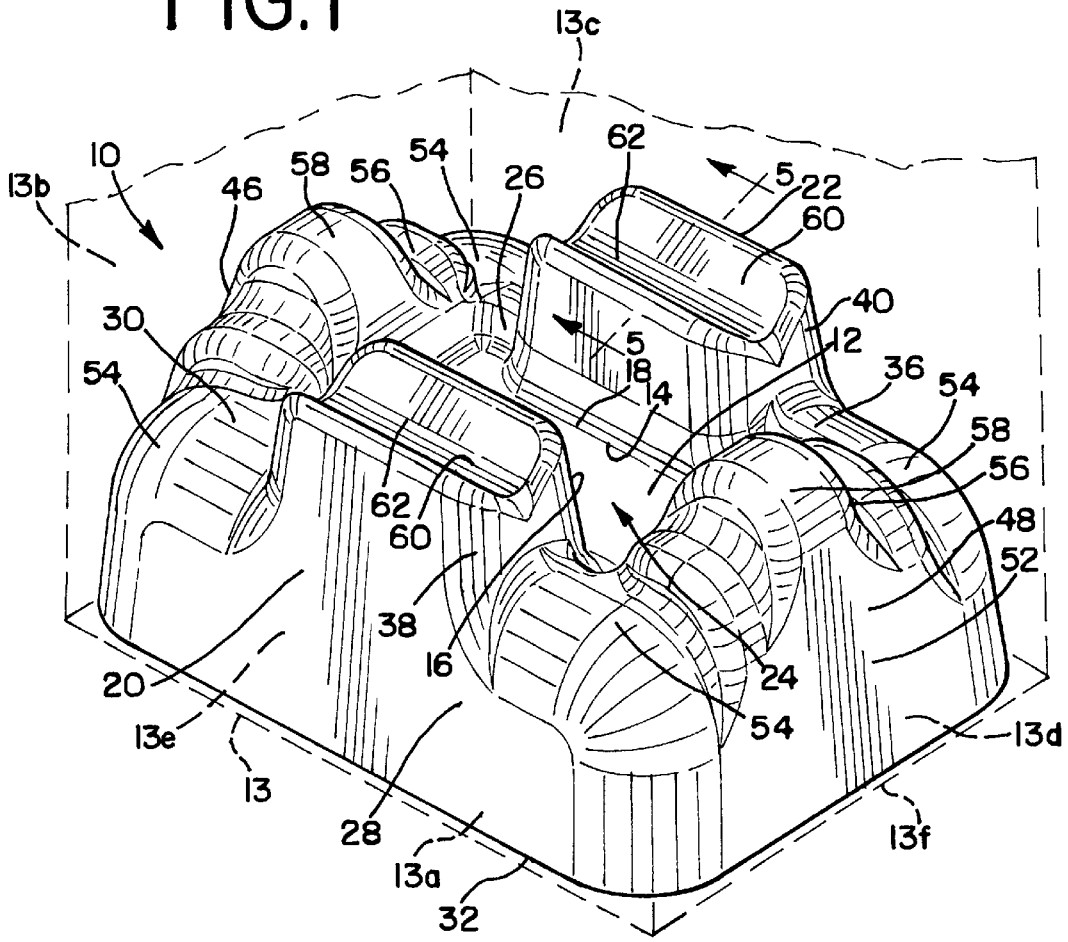
FIG. 1 is a top perspective view of a preferred embodiment of the present package structure.

Referring now to the drawings, and particularly to FIGS. 1–4, a preferred embodiment of the present unitary packaging structure is generally designated 10. The structure 10 is adapted to support and hold an end portion of a shock sensitive article 11 (shown in phantom in FIG. 3) such as a computer disk drive, a printed circuit board, or the like. An important feature of the present package, in its several embodiments, is that ability to control the resiliency, or shock absorption characteristics, by the configuration of the package itself.

A pair of the packaging structures 10 preferably holds opposing end portions of the article 11, and will normally be positioned within a container 13 (shown in phantom in FIG. 1) such as a box or corrugated carton. The container 13 is formed with multiple panels 13*a*–13*f*. The packaging structure 10 is preferably positioned to contact the panels of the container 13 in a relatively tight fitting arrangement about the packaging structure 10 and the protected article 11.

Generally, the packaging structure 10 is in the form of a tray having a central flange 12 adapted to support the article 11 against movement in a perpendicular direction relative to a plane defined by the flange, and towards an adjacent panel 13*f* of the container oriented in a plane parallel to the flange. Additionally, the flange 12 contains a peripheral portion 14 with a pair of opposing sides 16 and 18 each part of one of a corresponding first sidewall structure 20 and a second sidewall structure 22. The sidewall structures 20 and 22 form at least a portion of an enclosure 24 which, when viewed from the direction in which the article 11 extends, is generally configured in the shape of the end portion of the article. Such shapes may take the form of a polygon, or of an arcuate structure such as a circle or ellipse.

Figure 2:
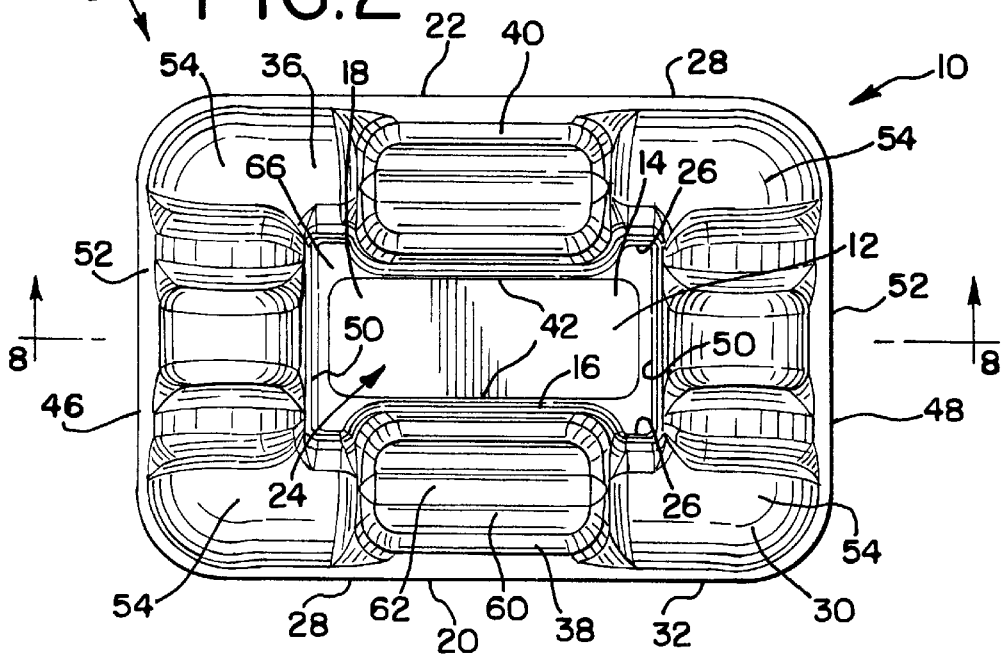
FIG. 2 is an overhead plan view of the package structure shown in FIG. 1.

The first sidewall 20 and the second sidewall 22 are located along the respective opposing sides 16 and 18 of the flange 12, and each include an inboard wall 26 integral with the peripheral portion 14 of the flange 12, and an outboard wall 28 (best seen in FIG. 2). Also, the outboard wall 28 of each of the sidewall structures 20 and 22 has an article end 30 and a container end 32 (best seen in FIG. 1). The container ends 32 of the sidewall structures 20 and 22 depend from a bottom or underside 33 of the flange 12 and extend towards the adjacent panel 13*f* of the container 13. Thus, a dampening space 34 (best seen in FIG. 3) is formed between the flange 12 and the container end 32 of the sidewall structures 20 and 22. A bridge section 36 integrally joins adjacent upper portions of the inboard wall 26 and the outboard wall 28, preferably at the upper or article end 30 of the sidewall structures 20 and 22, to laterally space the outboard wall 28 from the inboard wall 26.

Figure 3:
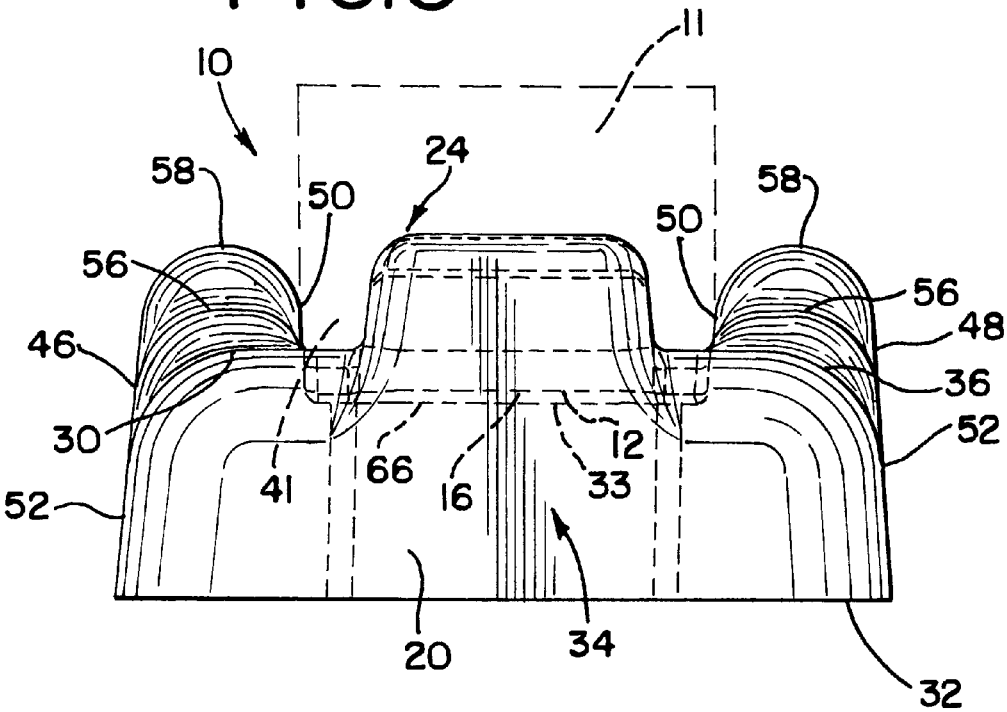
FIG. 3 is a side elevational view of the package structure shown in FIG. 1.
Figure 4:
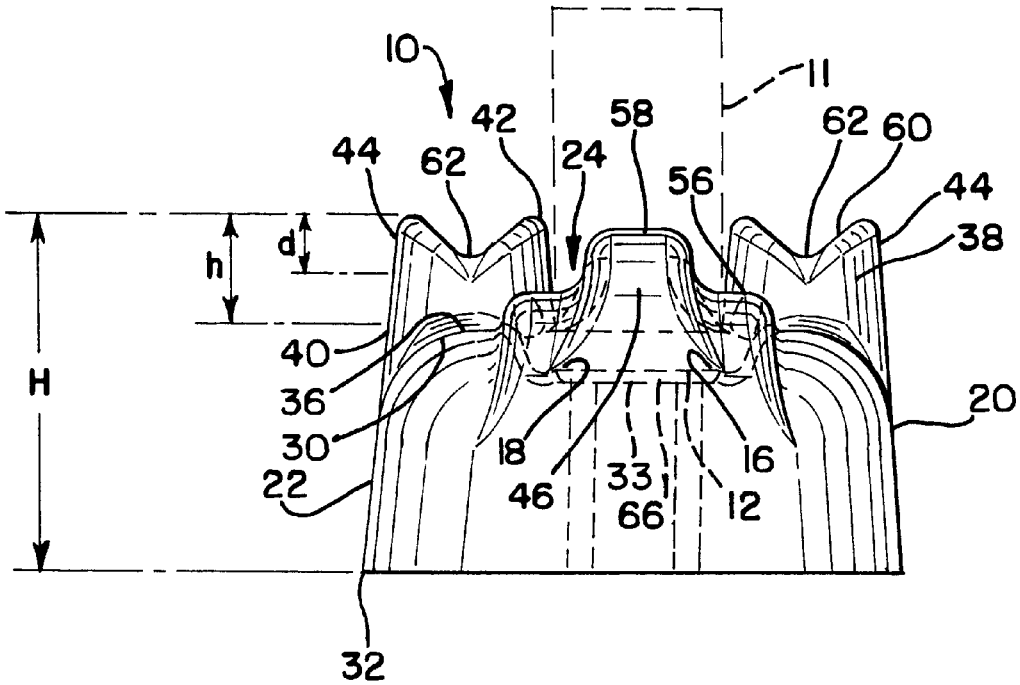
FIG. 4 is an end elevational view of the package structure shown FIG. 1.

Referring to FIGS. 3 and 4, a first column formation 38 is formed integrally with the first sidewall 20 and a second column formation 40 is formed integrally with the second sidewall 22. The column formations 38 and 40 each include an inside wall 42 and an outside wall 44. The first and second column formations 38 and 40 extend into the enclosure space 24 defined by the flange 12 so that the inside walls 42 of the opposing formations 38, 40 are closer to each other than are the opposing sidewalls 20, 22. It is contemplated that the actual distance between the opposing formations 38, 40 may change to suit the application, and more specifically, the particular article being packaged. It is preferred that the column formations 38, 40 are configured to exert a slight frictional gripping force on the article 11.

Referring again to FIGS. 1–3 preferably, the unitary packaging structure 10 also includes a first endwall 46 and a second endwall 48 at opposite ends of the flange 12. The first and second endwalls 46 and 48 each have an inner wall 50 and an outer wall 52 (best seen in FIG. 3). Inner walls 50 of the endwalls 46 and 48 are integral with the peripheral portion 14 of the flange 12 and the inboard walls 26 of the sidewalls 20 and 22. Moreover, the outer walls 52 are integral with the outboard walls 28 of the sidewalls 20 and 22 to the extent that corners 54 are formed at the intersection of walls 28 and 52.

For use in applications where increased rigidity is desired, the endwalls 46 and 48 include a lower shoulder 56 which is adapted to be shorter in length and taller in height than the endwalls 46 and 48. Additionally, the end walls 46 include an upper shoulder 58 which is adapted to be shorter in length and taller in height than the lower shoulder 56. By design, having two shoulders 56 and 58 in a stepped configuration, as shown in FIGS. 1–4 makes the endwalls 46 and 48 more resistant to deformation upon shock impact of the endwalls. Alternately, the shoulders 56 and 58 can be varied in height and width, or removed altogether, to adjust the rigidity of the endwalls 46 and 48 to meet a required rigidity for a particular application.

To allow shock to be dissipated through the unitary packaging structure 10, the structure is formed of a flexible, preferably polymeric, material to allow shocks to be dissipated primarily via flexing of the walls which, after such flexing, elastically return to their original shape. An advantage of this property is that the present packaging structure 10 may absorb repeated shock impacts without deteriorating. Any of a number of polymeric materials can be utilized to form the unitary packaging structure 10. Generally, such materials will be characterized by the physical properties of durability, elasticity or "memory", high and low temperature stability, and thermoformability.

Particularly useful for forming the unitary packaging structure 10 of the present invention is high density polyethylene (HDPE), although other polymeric materials may be equally suitable, depending on the application. High density polyethylene generally has a stiffness of about 150,000 psi. This provides sufficient flexibility for the purposes of the present invention and sufficient elasticity so that the packaging structure 10 will return to its original loaded or less stressed state following absorption of a shock. If desired, the HDPE used in making the packaging structure 10 may be recycled, post-consumer material. It is also contemplated that the material may have anti-static or other electrically insulative properties as are well known the art.

The sheets of polymeric material which are thermoformed into the packaging structure 10 will generally be from about 10 to about 90 gauge (mils) in thickness. However, other gauges are contemplated depending on the particular application. In addition to thermoforming, it is contemplated that the present packaging structure 10 may also be produced by injection molding. Regardless of the method of manufacture, the particular thickness of the polymeric material making up the unitary packaging structure 10 will be a function of the specific properties of the polymeric material itself, and the weight and shape of the shock sensitive article 43 which is to be supported by the particular packaging structure 10. Generally, the packaging structure 10 of the present invention can be designed to provide sufficient protection for the packaged article to provide protection as low as the 20 g level under all ambient weather conditions.

To further dissipate shock and protect the article, the first and second column formations 38 and 40 contain a groove 60 formed in the cushion area defined between the inside walls 42 and the outside walls 44 of each column formation 38 and 40. A generally linearly extending hinge point 62 of the groove 60 provides both flexibility and facilitates return of the column formations 38 and 40 to their original shape after impact, thus allowing the unitary structure 10 to hold its shape even after it has received multiple impacts. A depth "d" of the groove 60 corresponds to a height "h" of the column formations 38 and 40 (as seen in FIG. 4), and preferably extends a length of the column formations (as seen in FIGS. 1 and 2). However, grooves 60 which do not extend the full length of the column formation are also contemplated.

In a first embodiment, the groove 60 is V-shaped when viewed in cross-section and has a depth "d" which is approximately one half the height "h" of the column formation (best seen in FIGS. 1 and 4). An elastic characteristic of the column formations 38 and 40 increases as the groove depth "d" grows in relation to the height "h" of the column formations 38 and 40.

Figure 5:
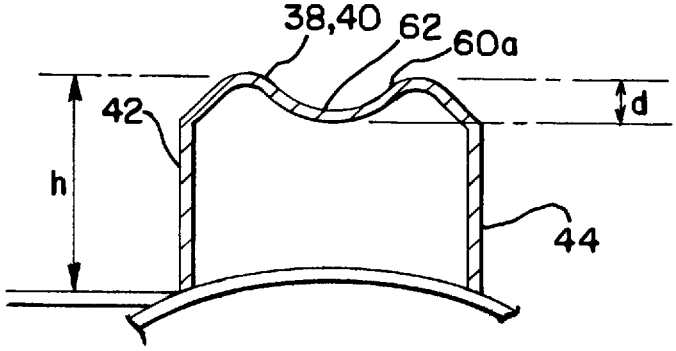
FIG. 5 is a fragmentary cross-sectional view of an alternate embodiment of a V-groove formation of the present package structure taken along the line 5—5 of FIG. 1 and in the direction generally indicated.

Referring now to FIG. 5, in an alternate embodiment referred to as 60*a,* the groove 60*a* is V-shaped when viewed in cross-section and has a depth "d" which is approximately one quarter the height "h" of the column formations 38 and 40. In this instance, the column formations 38 and 40 become stiffer or more resilient than the column formations in the first embodiment. In this manner, the depth "d" of the groove 60 can be varied depending on the particular application of the unitary structure 10.

Figure 6:
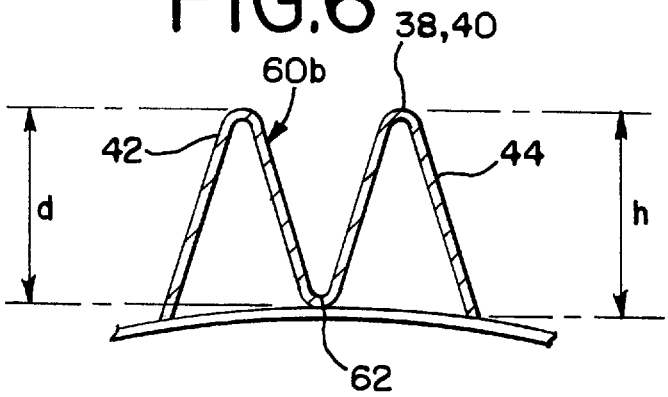
FIG. 6 is a fragmentary cross-sectional view of another alternate embodiment of a V-groove formation of the present package structure taken along the line 5—5 of FIG. 1 and in the direction generally indicated.

Referring now to FIG. 6, in another alternate embodiment of the groove 60, indicated as 60*b,* the inside wall 42 and the outside wall 44 of the first and second column formations 38 and 40 are tapered, preferably to the depth "d" of the groove 60*b,* thus forming an M-shape when viewed in cross-section. In this embodiment, the groove depth "d" generally equals the height "h" of the column formations 38 and 40.

Figure 7A:
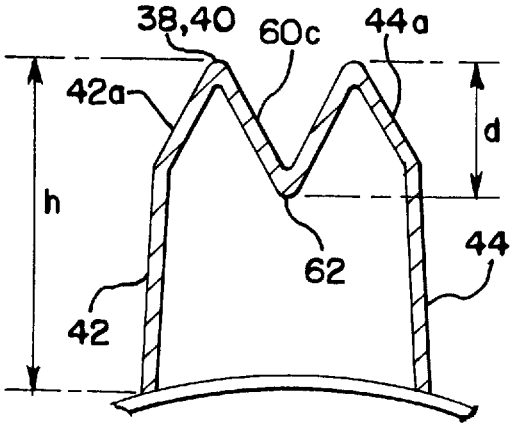
FIGS. 7A and 7B are fragmentary cross-sectional views of yet other alternate embodiments of a V-groove formation of the present package structure taken along the line 5—5 of FIG. 1 and in the direction generally indicated.
Figure 7B:
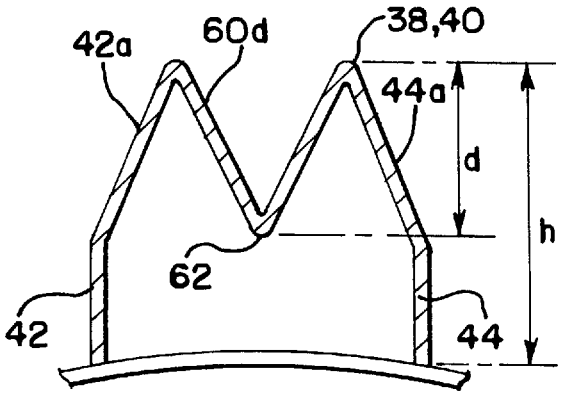

Referring now to FIG. 7*a,* in yet another embodiment of the groove 60 indicated as 60*c,* the groove depth "d" is approximately one quarter the height "h" of the column formations 38 and 40, and upper portions 42*a,* 44*a* of the inside and outside walls 42 and 44 are tapered to match the groove depth "d". Alternately, referring now to FIG. 7*b,* this version of the groove is depicted as 60*d,* and the groove depth "d" is shown as approximately half the height "h" of the column formations 38 and 40. Also, the inside and outside walls 42 and 44 are tapered to the approximate depth of the groove depth "d". As stated earlier, it is contemplated that the ratio of the depth "d" to the height "h" may be modified, depending on the required rigidity for a particular application of the unitary packaging structure 10.

Figure 8:
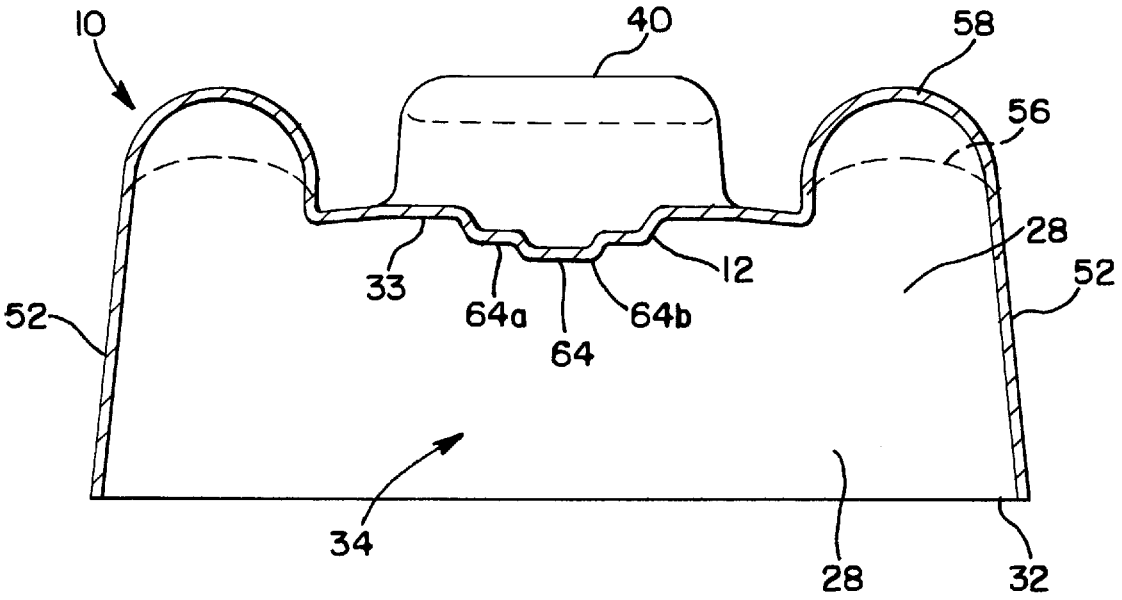
FIG. 8 is a cross-sectional view of an embodiment of a crush bump formation of the present package structure taken along the line 8—8 of FIG. 2 and in the direction generally indicated.
Figure 9:
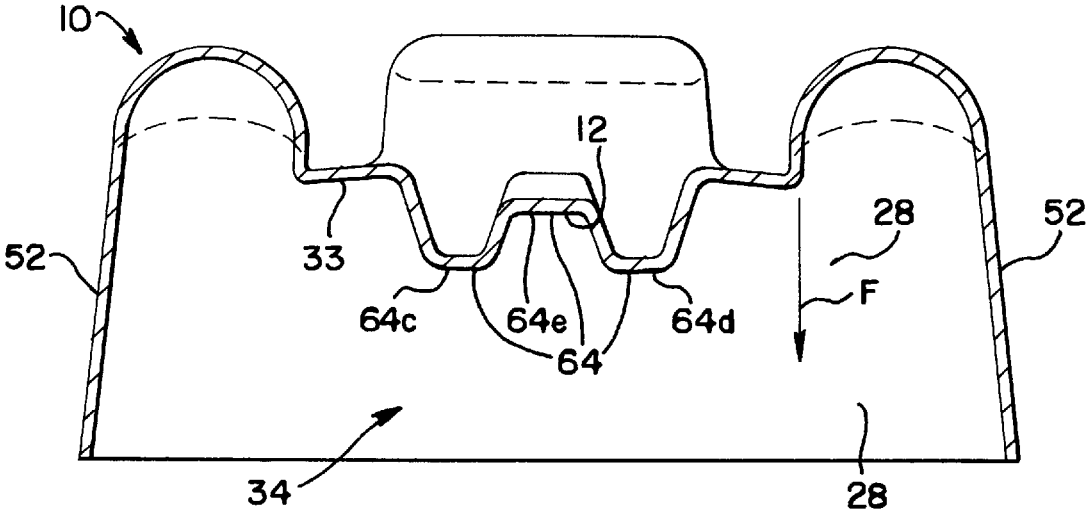
FIG. 9 is a cross-sectional view of another embodiment of a crush bump formation of the present package structure taken along the line 8—8 of FIG. 2 and in the direction generally indicated.

Referring now to FIGS. 8 and 9, while the grooves 60 of the column formations 38 and 40 aid to deplete shock received in a generally lateral direction, or perpendicular to a plane of the outboard wall 28, at least one crush bump 64 integral with the flange 12 of the unitary packaging structure 10 may be provided to help to absorb shock in another, generally vertical direction, when viewed in relation to the structure 10 as shown in FIG. 8. The at least one crush bump 64 depends from the bottom 33 of the flange 12 in a direction towards the container panel 13*f* (best seen in FIG. 1).

Referring now to FIG. 8, one crush bump 64 is shown formed integral with the flange 12. The crush bump 64 is generally stepped, providing two levels, designated 64*a,* 64*b* of cushion distance relative to the flange 12. The depth, or the distance the crush bump 64 depends from the underside 33 may vary depending on the application.

Referring now to FIG. 9, two crush bumps 64*c,* 64*d* are provided in spaced relationship to each other and are spaced apart by a depressed platform 64*e.* The formations 64*c* and 64*d* are also integral with the flange 12, and extend towards the container to create a cushion distance between the respective bottoms of the crush bumps 64*c,* 64*d* and 64*e,* and the flange 12.

In both embodiments, shown in FIGS. 8 and 9, the at least one crush bump 64 operates to slow the movement of the packaged article 11 during an impact of the container 13. Such impact could occur when the container is dropped vertically, and the crush bumps 64 reduce g-forces exerted on the article to correspondingly reduce the level of breakage encountered by the article. In use, as the container 13 which contains the present structure 10 and the corresponding packaged article 11 impacts a solid surface, the outboard walls 28 of the sidewall structures 18 and 20, and the outer walls 52 of the endwalls 46 and 48, contract or accommodate vertical movement of the flange 12 towards the adjacent container surface, in the direction of arrow F (best seen in FIG. 9) to absorb force of the impact. If the force is high enough in magnitude, the walls 28 and 52 will continue to contract until a panel of the container encounters the crush bump 64. Thereafter, the crush bump 64 acts to further absorb the g-force, and returnably collapses in the process.

Referring again to FIGS. 2–4, as an option, the flange 12 is preferably provided with a depending channel 66 to provide rigidity to the flange. The channel 66 is formed in a generally "I"-frame shape when viewed from above, and circumscribes the peripheral portion 14 of the flange 12. It has been discovered that, with a lightweight article 11 to be packaged, in some cases the crush bump 64 can be removed and replaced with the channel 66 which also provides some shock absorption by creating a small cushion distance between the flange 12 and the adjacent container panel 13*f*. Since the crush bump 64 depends farther than the channel 66 towards the container, by removing the crush bump 64, the outboard wall 28 and the outer wall 52 are able to travel farther prior to impact to continue to lessen the force. Thus, an additional impact that occurs when the container encounters the crush bump 64 is eliminated. If and when the container panel reaches the channel 66, the channel 66 acts to absorb force.

Figure 10:
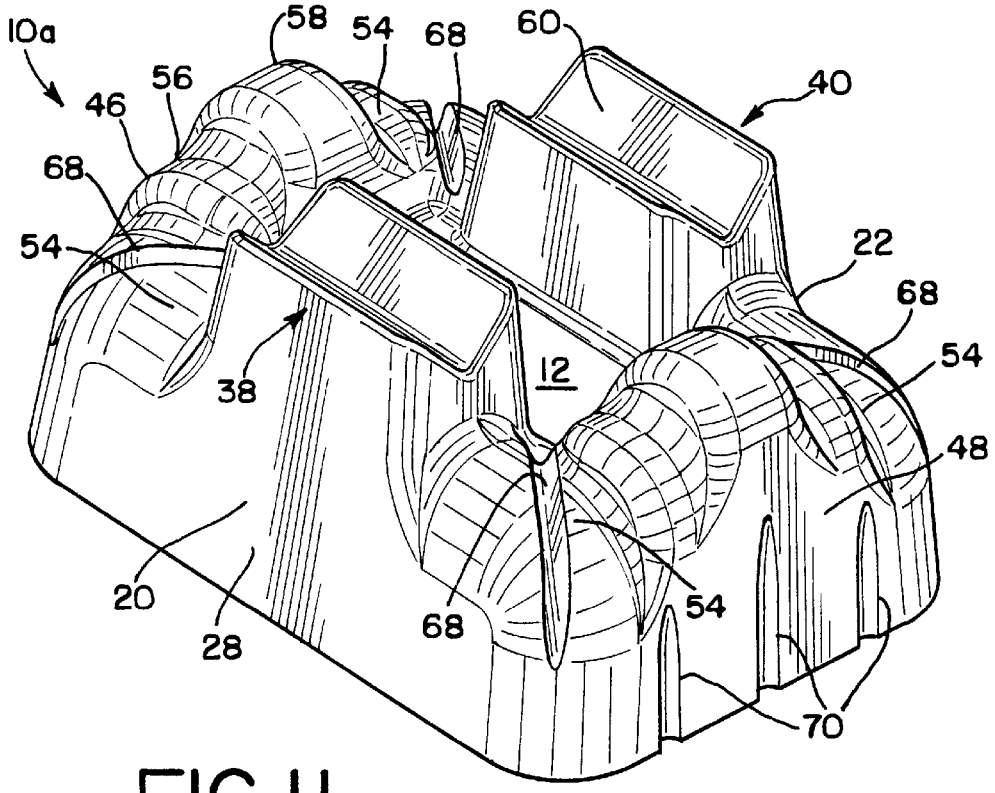
FIG. 10 is a top perspective view of another alternate embodiment of the present packaging article.

Referring now to FIG. 10, in an alternate embodiment, of the packaging structure 10, designated 10*a*, identical features to those of structure 10 are designated with identical reference numbers. In the structure 10*a*, the corner 54 includes a generally linear recess or groove 68 between at least one sidewall structure 20 and 22, and at least one endwall 46 and 48. By positioning the linear recesses 68 at the corners 54 of the unitary structure 10, the sidewall structures 20 and 22, as well as the endwall structures 46 and 48, are able to move independently of each other to further protect the article 11. Additionally, the outer wall 52 of each endwall 46 and 48 includes generally vertically projecting depressions or grooves 70 to strengthen the endwalls. Additional grooves 70 may be added to the outboard walls 28 if desired for added strength.

Figure 11:
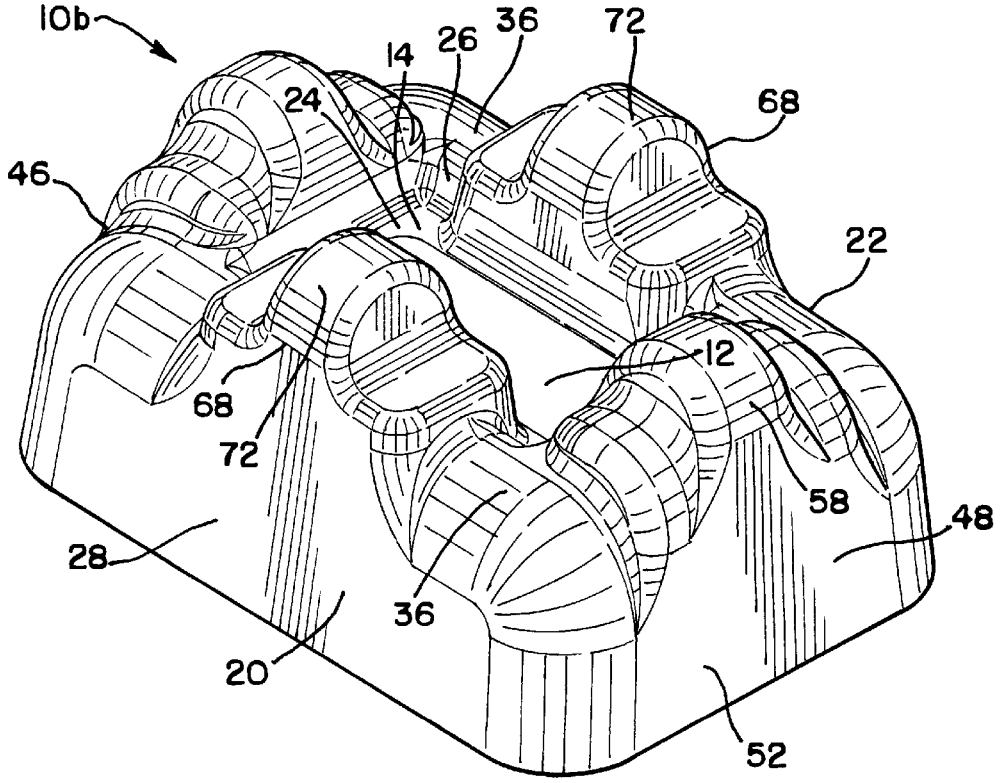
FIG. 11 is a top perspective view of yet another alternate embodiment of the present packaging article.

Referring now to FIG. 11, another alternate embodiment of the unitary structure 10 is generally designated 10*b*. Features of the structure 10*b* which are identical to the structure 10 are designated with identical reference numerals. As described above, the unitary structure, 10*b* has a flange 12 with a surface adapted to support the article 11 (best seen in FIG. 3) against excessive shock-induced movement. Additionally, a plurality of sidewall structures 20 and 22 and endwall structures 46 and 48 are formed of a flexible material. The sidewall structures 20 and 22 include inboard walls 26 integral with a peripheral portion 14 of the flange 12, and outboard walls 28. A bridge section 36 integrally joins the inboard walls 26 and the outboard walls 28 to space the outboard walls 28 from the inboard walls 26 and form a cushion space. Shoulder structures 72, similar to the shoulders 56 and 58 described above, are integrally joined to at least one and preferably both sidewall structures 20, 22 to extend into an enclosure 24 defined by the flange 12. The shoulder structures 72 are constructed to be closer to each other than are the opposing inboard walls 26, and thus supportingly extend over an end portion of the article and exert a frictional holding force against the packaged article 11.

Figure 12:
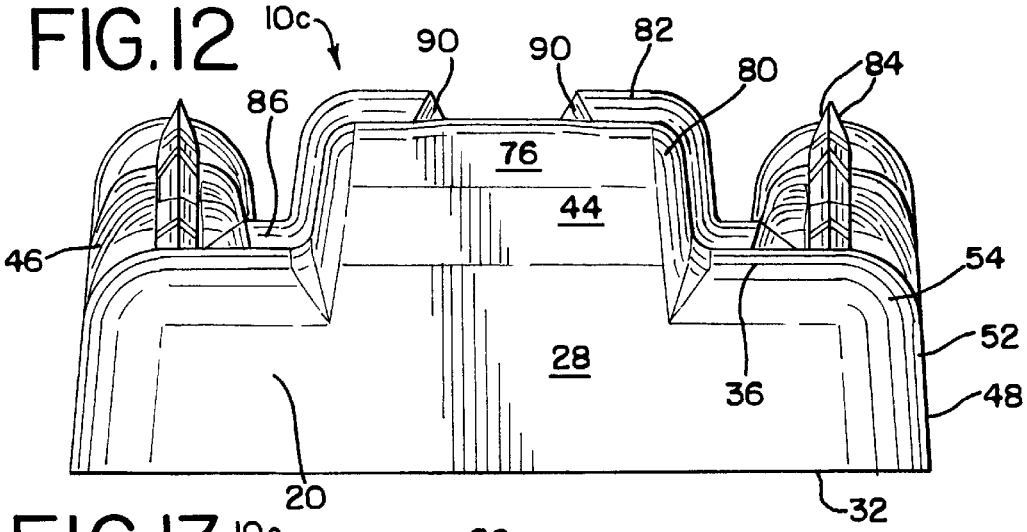
FIG. 12 is a side elevational view of still another alternate embodiment of the present invention.
Figure 13:
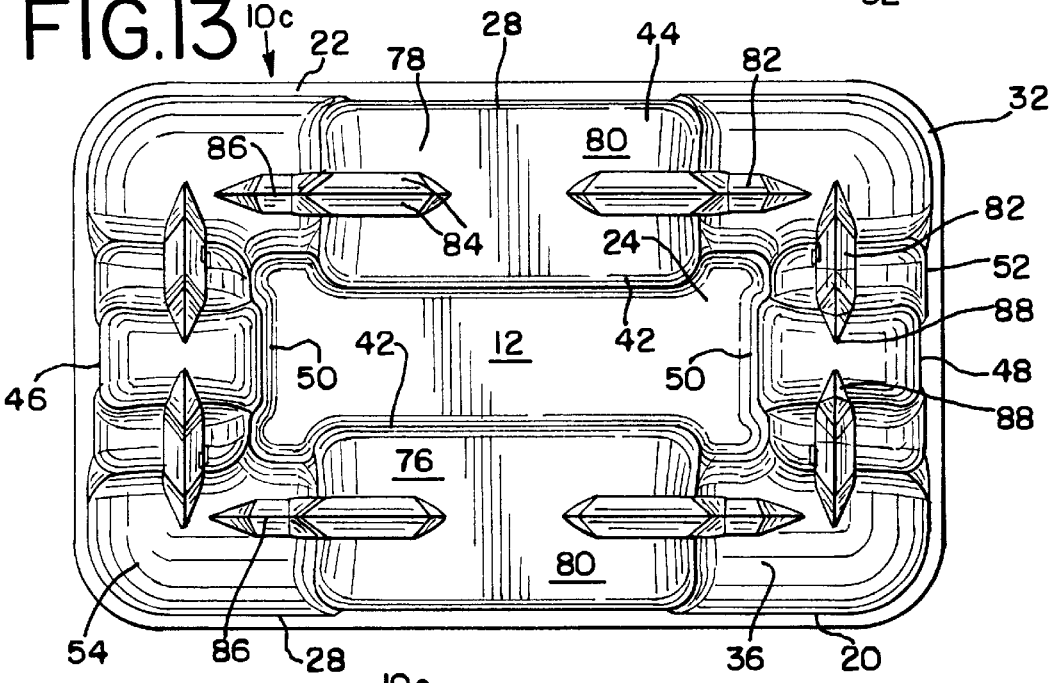
FIG. 13 is an overhead plan view of the embodiment of FIG. 12.
Figure 14:
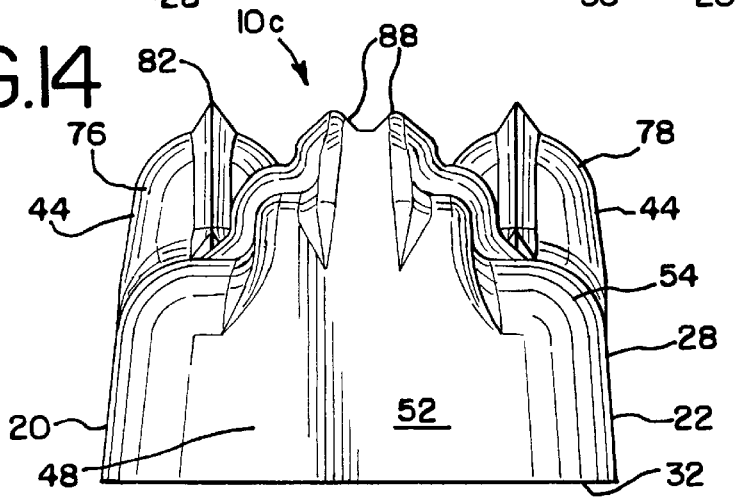
FIG. 14 is an end elevational view of the embodiment of FIG. 12.

Referring now to FIGS. 12–14, still another alternate embodiment of the present structure 10 is generally designated 10*c*. Components of the structure 10*c* which are identical to corresponding components of the structure 10 have been designated with identical reference numbers.

A main difference between the structure 10*c* and the structure 10 is that in the structure 10*c*, the column formations 38, 40 have been reconfigured. Now designated 76, 78, the column formations no longer have the groove 60, but instead have a radiused top portion 80 which is integrally joined to the inside and outside walls 42, 44, and which is generally parallel in orientation to the bridge section 36. At least one of the side walls 20, 22 and at least one of the end walls 46, 48 is provided with a peaked ridge formation 82 for controlling the rigidity of the respective side wall or endwall.

Each ridge formation 82 is made of a pair of angled panels 84 which, when joined along a common upper edge, form a generally triangular shape when viewed in vertical cross section. Since the ridge formations 82 on both the column formations 76, 78 and the endwalls 46,48 are integrally formed from the supporting structure, they create a spring-like resiliency to an otherwise relatively rigid wall shape. Particularly in the case of the column formations 76, 78, the hemispherically-shaped or radiused top 80 portions create a relatively rigid shape which resists lateral impacts. The same is true for the step-shouldered endwalls 46, 48. Thus, the addition of the ridge formations affords the designer a mechanism for tuning the resiliency of the package 10*c* to suit a particular packaged article 11. The size and shape of the ridge formations may be adjusted to change resiliency.

In the preferred embodiment, the ridge formations 82 are shaped to follow the contour of upper edges of the corresponding side wall or endwall of the structure 10*c*. More particularly, the ridge formations are generally inverted "L"-shaped on the column formations 76, 78, with an integral tail portion 86 extending onto the bridge section 36, and are generally "W"-shaped on the endwalls 46, 48 to follow the multi-shouldered contour described above.

On the endwalls 46,48, upper ends 88 of the ridge formations are spaced from each other. Similarly, upper ends 90 of the ridge formations on the sidewalls 20, 22 (on the column formations 38, 40) are also spaced from each other. Due to the respective greater lengths of the column formations 38, 40 relative to the endwalls 46, 48, the spacing between the respective upper ends 90, 88 is also greater.

It will be seen that the provision of the ridge formations 82 on the sidewalls 20, 22 and the end walls 46, 48 will increase the ability of those wall structures to compress upon the receipt of a laterally-directed shock load. Also, depending on the type and weight of the article 11 being packaged, the present packages 10, 10*a*, 10*b* and 10*c* may be provided in several distinct configurations which may be used to alter the resiliency, or shock absorbing characteristics as needed. It is preferred that all of the embodiments include a column formation which is used to provide at least a slight friction retaining force upon the packaged article to secure the article in the package.

While particular embodiments of the packaging article with controlled resiliency according to the present invention have been shown and described, it will be appreciated by those skilled in the art that changes and modifications may be made thereto without departing from the invention in its broader aspects and as set forth in the following claims.

What is claimed is:

1. A structure for packaging a shock sensitive article within a container having a plurality of panels, the structure comprising:

a flange having a bottom surface, and a peripheral portion including a pair of opposing sides, said flange defining an article containing space;

a first sidewall and a second sidewall located along said opposing sides of said flange, said first and second sidewalls each including an inboard wall integral with said peripheral portion of said flange, an outboard wall having an article end and a container end depending from said bottom surface, and a bridge portion joining corresponding edges of said inboard wall and said outboard wall, to form a cushion space; and at least one column formation formed integrally with said first sidewall and said second sidewall, each said at least one column formation having an inside wall and an outside wall, and extending from said inboard wall into said article containing space to be closer to the opposing column formation than said inboard walls are to each other, said inside wall being configured for supportingly extending over an end portion of the article.

2. The structure of claim 1 wherein said at least one column formation has at least one groove formed between said inside wall and said outside wall.

3. The structure of claim 2 wherein said at least one groove has a depth corresponding to a height of said column formation and extends a length of said column formation.

4. The structure of claim 2 wherein said at least one groove has a depth which is approximately one half the height of said column formation.

5. The structure of claim 2 wherein said at least one groove has a depth which is approximately one quarter the height of said column formation.

6. The structure of claim 2 wherein said at least one groove is V-shaped when viewed in cross-section.

7. The structure of claim 2 wherein said inside and said outside walls of said at least one column formation is tapered to said depth of said at least one groove to form an M-shape when viewed in cross-section.

8. The structure of claim 3 wherein said height of said at least one column formation is greater than half of a height of the packaging structure.

9. The structure of claim 1 wherein said flange further comprises means for absorbing shock loading of the article, said shock absorbing means being integral with said flange and generally extending from said bottom surface of said flange in a direction away from the article.

10. The structure of claim 9 wherein said shock absorbing means includes at least one crush bump.

11. The structure of claim 10 wherein said crush bump is generally conical in shape and forms a cushion distance from said flange.

12. The structure of claim 10 wherein said shock absorbing means includes a channel.

13. The structure of claim 12 wherein said channel circumscribes said peripheral portion of said flange to define a cushion distance.

14. The structure of claim 1 further including a first endwall and a second endwall at opposite ends of said flange, said first and second endwalls having an inner wall and an outer wall, said inner walls of said endwalls being integral with said peripheral portion of said flange and said inboard walls of said sidewalls, said outer walls being integral with said outboard walls of said sidewalls to form a corner.

15. The structure of claim 14 wherein said corner further includes a recess between at least one sidewall and at least one endwall.

16. The structure of claim 14 wherein at least one endwall includes a lower shoulder, portion located on each side of an upper shoulder portion, said upper shoulder portion being shorter in length and taller in height than said lower shoulder portions.

17. The structure of claim 14 wherein said outer wall of said end wall includes depressions.

18. The structure of claim 14 wherein at least one of said side walls and said end walls in provided with a peaked ridge formation.

19. The structure of claim 18 wherein said ridge formations are generally "L"-shaped and positioned on corners of said corresponding at least one side wall and end wall.

20. A structure for packaging a shock sensitive article within a container having a plurality of panels, the structure comprising:

a flange having a bottom surface, and a peripheral portion including a pair of opposing sides, said flange defining an article containing space;

a first sidewall and a second sidewall located along said opposing sides of said flange, said first and second sidewalls each including an inboard wall integral with said peripheral portion of said flange, an outboard wall having an article end and a container end depending from said bottom surface, and a bridge portion joining corresponding edges of said inboard wall and said outboard wall, to form a cushion space;

at least one column formation formed integrally with each of said first sidewall and said second sidewall, each said column formation having an inside wall and an outside wall, and extending from said inboard wall into said article containing space to be closer to each other than said inboard walls are to each other, said inside wall being configured for supportingly extending over an end portion of the article;

a first endwall and a second endwall at opposite ends of said flange, said first and second endwalls having an inner wall and an outer wall, said inner walls of said endwalls being integral with said peripheral portion of said flange and said inboard walls of said sidewalls, said outer walls being integral with said outboard walls of said sidewalls;

at least one of said side walls and at least one of said end walls is provided with a peaked ridge formation for controlling the rigidity of said respective side wall or endwall.

21. The structure as defined in claim 20 wherein said ridge formations are located on said column formations and on each of said end walls.

22. The structure as defined in claim 20 wherein said ridge formations are shaped to generally follow the contour of upper edges of the corresponding side wall and end wall.

* * * * *